US010287833B2

(12) United States Patent
Hassard et al.

(10) Patent No.: US 10,287,833 B2
(45) Date of Patent: May 14, 2019

(54) CARRIER BLOCK AND GRIPPER BLOCK FOR COILED TUBING ASSEMBLY

(71) Applicant: Coil Solutions, Inc., Calgary (CA)

(72) Inventors: Cecil Hassard, Medicine Hat (CA); Marijana Juric, Calgary (CA); Bruce Lovstrom, Calgary (CA)

(73) Assignee: Coil Solutions, Inc., Calgary (CA)

( * ) Notice: Subject to any disclaimer, the term of this patent is extended or adjusted under 35 U.S.C. 154(b) by 30 days.

(21) Appl. No.: 15/342,901

(22) Filed: Nov. 3, 2016

(65) Prior Publication Data

US 2017/0159382 A1 Jun. 8, 2017

Related U.S. Application Data

(60) Provisional application No. 62/250,330, filed on Nov. 3, 2015.

(51) Int. Cl.
*E21B 19/22* (2006.01)
*E21B 19/084* (2006.01)

(52) U.S. Cl.
CPC ..... *E21B 19/22* (2013.01); *E21B 19/084* (2013.01)

(58) Field of Classification Search
CPC ..... E21B 19/084; E21B 19/22
See application file for complete search history.

(56) References Cited

U.S. PATENT DOCUMENTS

| | | | | |
|---|---|---|---|---|
| 9,243,463 | B2 | 1/2016 | Hassard | |
| 2015/0167405 | A1* | 6/2015 | Hickey | E21B 19/08 166/379 |
| 2015/0240577 | A1 | 8/2015 | Hassard et al. | |
| 2015/0361739 | A1* | 12/2015 | Quirion | E21B 19/22 166/379 |

FOREIGN PATENT DOCUMENTS

| | | | |
|---|---|---|---|
| CN | 104929546 | A | 9/2015 |

OTHER PUBLICATIONS

International Search Report and Written Opinion dated Dec. 23, 2015, issued in International Application No. PCT/CA16/51280.
www.zycon.com/Profile/Fixtureworks-226804/Hold-Down-Claimps.html, Jul. 22, 2015.
International Preliminay Report on Patentability dated May 8, 2018, in International Application No. PCT/CA16/51280.

* cited by examiner

*Primary Examiner* — D. Andrews
*Assistant Examiner* — Kristyn A Hall
(74) *Attorney, Agent, or Firm* — Ramey & Schwaller, LLP; William Ramey; Craig Buschmann

(57) ABSTRACT

A combination of a carrier block and gripper block is disclosed. The gripper block includes a first side and a second side spaced apart from the first side, and an upper surface spanning the distance between the first side and the second side. The upper surface includes a gripping surface. The gripper block includes at least one recess positioned in at least one of the first side and the second side of the gripper block, the at least one recess including an engagement surface. A retention device includes a retention feature proximate the first end and extending laterally away from a longitudinal axis of the retention device. The carrier block includes at least one retention recess disposed at least partially through the carrier block, the at least one retention recess being configured to receive a second end of the retention device.

12 Claims, 9 Drawing Sheets

CARRIER BLOCK AND GRIPPER BLOCK FOR COILED TUBING ASSEMBLY

CROSS-REFERENCE TO RELATED APPLICATION

This application claims the benefit of U.S. Provisional Application No. 62/250,330, filed Nov. 3, 2015.

BACKGROUND

The present invention relates to gripper blocks and carrier blocks that are coupled to an apparatus that conveys tubing into a bore. For example, embodiments of the disclosed gripper blocks and carrier blocks are suitable for use with coiled tubing injection equipment for use in the oil and gas industry.

Coiled tubing has been used for many years to conduct various interventions within a bore, pipe, or pipeline, including drilling, completions, inspections, and other interventions. Coiled tubing apparatus includes a reel of tubing that is withdrawn or returned from the reel via an injector. The injector typically use a pair of opposed endless/infinite (i.e., looped) gripper chains mounted in a common plane. Coupled to the chains are a series of carrier blocks, to which are coupled replaceable gripper blocks. The opposing gripper blocks are configured to grasp the tubing and apply sufficient force to inject or retract the tubing from a bore as the gripper block/carrier block combination move in a loop via the gripper chains.

Various types of gripper blocks have been used over the years. One of the most common types includes a gripper block with a dovetail feature on its lower surface. The dovetail of the gripper block is configured to be slid into a complementary dovetail feature on an upper surface of the carrier block. This provides the ability to replace the gripper blocks relatively easily.

The dovetail connection, however, has several deficiencies. There needs to be sufficient clearance between the dovetail features of the gripper block and the complementary dovetail features of the carrier block to permit a user to slide the gripper block relative to the carrier block to couple/decouple the gripper block from the carrier block. This clearance, however, may permit movement of the gripper block relative to the carrier block during use.

This relative movement may have been tolerable with smaller tubing sizes. The industry, however, frequently is using larger diameter tubing (e.g., tubing greater than 2.625 inches/66.7 millimeter diameter) during operations than it has in the past. This larger diameter tubing imposes relatively greater forces on the gripper block and, consequently, the dovetail connection. Thus, the larger forces imposed by the larger diameter tubing may displace the gripper block from its aligned position relative to the carrier block and adjacent gripper blocks. This misaligned gripper block, then, could cause the misapplication or force and/or increased force to be applied to the tubing and/or the gripper block and/or the carrier block. Consequently, the misapplied and/or increased forces may risk binding the tubing and/or damaging the tubing, the gripper block, and the injector apparatus. For example, the narrow end portions of the dovetails act as a stress concentrator and pose a risk of breaking when the gripper block becomes misaligned relative to the carrier block.

Consequently, there is a need for an improved gripper block and carrier block assembly that provides easier assembly, tighter tolerances, and less relative movement between the gripper block and the carrier block during use. In addition, there is a need for an improved gripper block and carrier block that is capable of withstanding the larger forces encountered during use with larger diameter tubing.

BRIEF SUMMARY

A combination of a carrier block and gripper block assembly configured to be coupled to an apparatus that conveys a length of tubing into a bore includes the gripper block, the carrier block, and a retention device. The gripper block includes a first side and a second side spaced apart from the first side, and an upper surface spanning the distance between the first side and the second side. The upper surface includes a gripping surface that extends away from the upper surface, wherein the gripping surface includes at least one gripping element positioned thereon. The gripper block includes at least one recess positioned in at least one of the first side and the second side of the gripper block, the at least one recess including an engagement surface. The retention device is configured to couple the gripper block to a carrier block. The retention device includes a retention feature proximate the first end and extending laterally away from a longitudinal axis of the retention device. The retention feature is configured to engage with the engagement surface of the least one recess of the gripper block. The retention feature includes at least one of an arm extending laterally away from the longitudinal axis of the retention device and a collar that extends laterally away from the longitudinal axis of the retention device. The carrier block is configured to be coupled to the apparatus that conveys the length of tubing into the bore. The carrier block includes at least one retention recess disposed at least partially through the carrier block, the at least one retention recess being configured to receive a second end of the retention device.

In another embodiment, a combination of a carrier block and gripper block assembly configured to be coupled to an apparatus that conveys a length of tubing into a bore includes the carrier block, the gripper block, and a retention device. The gripper block includes a lower surface with at least one of a key and a slot, a first side and a second side spaced apart from the first side, and an upper surface spanning the distance between the first side and the second side, wherein the upper surface includes a gripping surface that extends towards the lower surface. The gripper block includes at least one recess positioned at least partially within at least one of the first side and the second side of the gripper block, the at least one recess including an engagement surface. The retention device is configured to couple the gripper block to a carrier block. The retention device includes a longitudinal axis extending between a first end and a second end of the retention device. The carrier block is configured to be coupled to the apparatus that conveys the length of tubing into the bore. The carrier block includes a carrier upper surface with an alignment feature configured to receive the at least one of the key and the slot of the gripper block. The carrier block includes at least one retention recess disposed at least partially through the carrier block, the at least one retention recess being configured to receive the second end of the retention device.

In yet another embodiment, a combination of a carrier block and gripper block assembly configured to be coupled to an apparatus that conveys a length of tubing into a bore includes the carrier block, the gripper block, and a retention device. The gripper block includes a first alignment means that align the gripper block to a carrier block, gripping means that are capable of gripping the length of tubing, and recess means that interact with a retention device. The retention device includes a longitudinal axis, the retention device being configured to couple the gripper block to a carrier block, the retention device including. The retention device further includes retention means extending at an angle away from the longitudinal axis of the retention device, the retention means interacting with the recess means of the gripper block to engage with the gripper block and coupling means that removably couple the retention device to the carrier block. The carrier block is configured to be coupled to the apparatus that conveys the length of tubing into the bore. The carrier block includes a second alignment means configured to engage with the first alignment means of the gripper block and a retention recess means configured to receive the coupling means of the retention device.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

DETAILED DESCRIPTION

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous. Stated differently, any features of any embodiments discussed below may be combined in part or in whole with other embodiments and other features; the features are not limited to the embodiment in which the feature is discussed.

Figure 1:
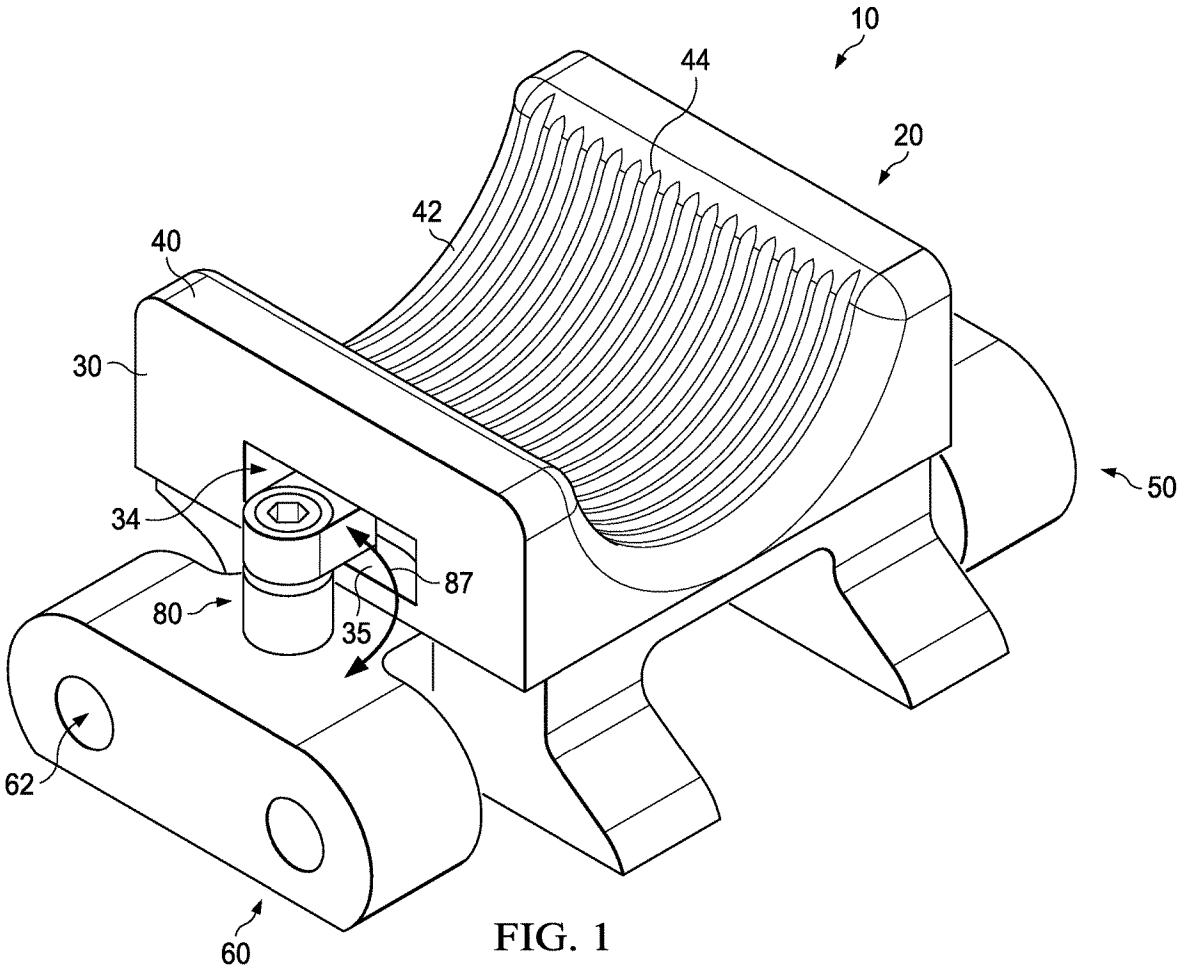
FIG. 1 is a perspective view of an embodiment of a combination of a gripper block, a carrier block, and a retention device.
Figure 2:
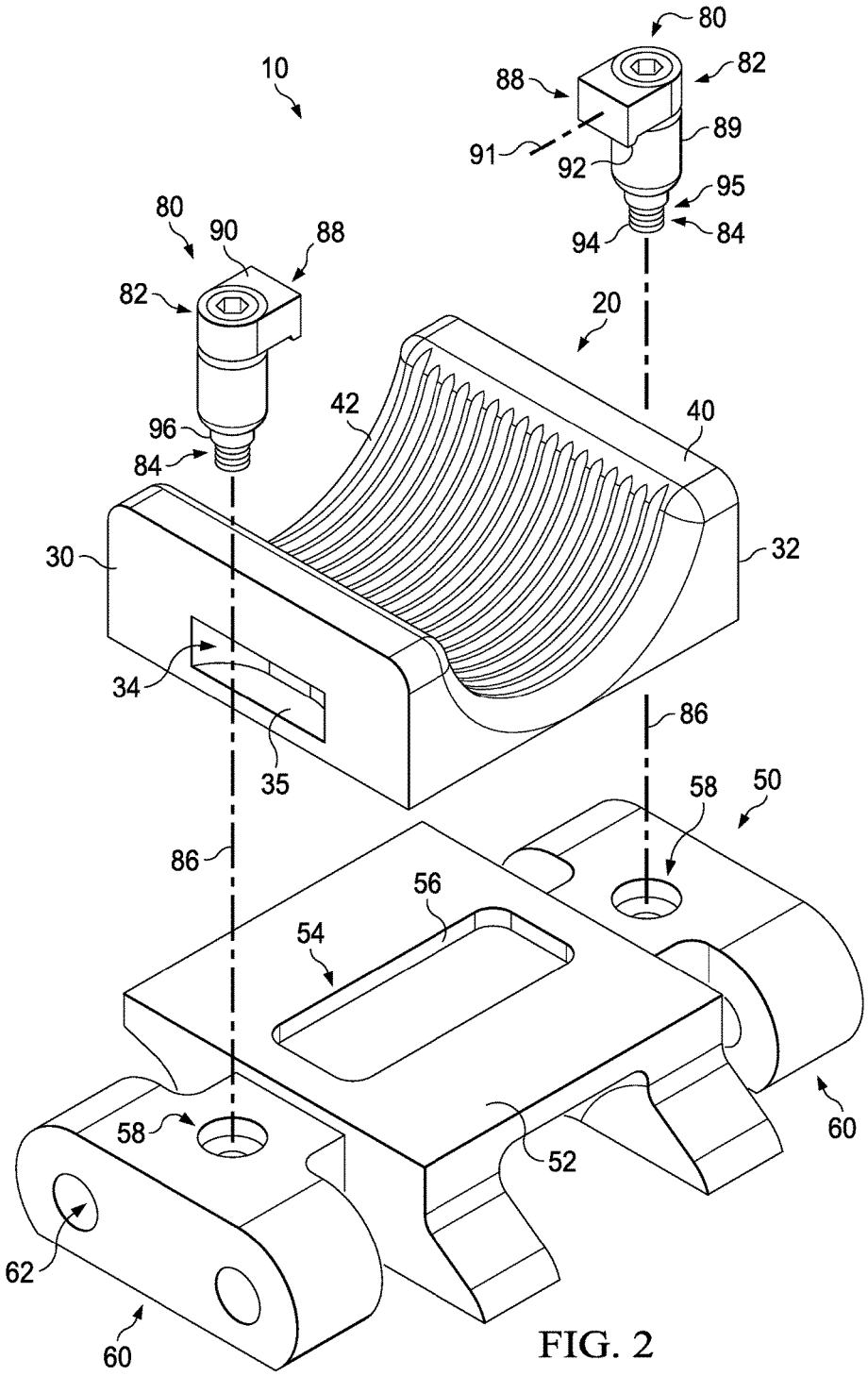
FIG. 2 is an exploded perspective view of the embodiment of the combination in FIG. 1.
Figure 3:
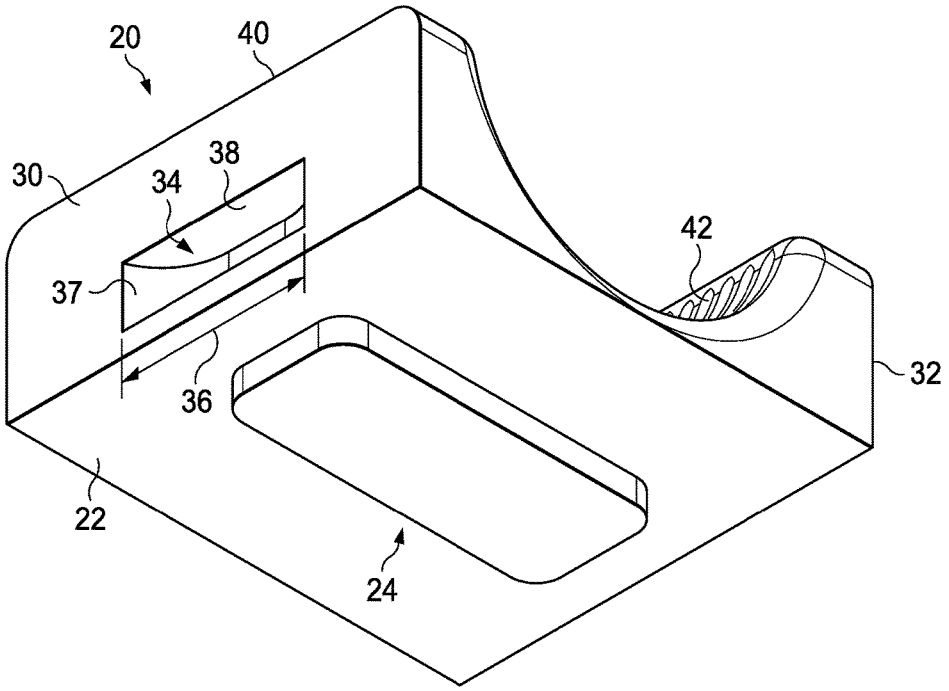
FIG. 3 is a lower perspective view of the embodiment of the gripper block in FIG. 1.

FIGS. 1-3 illustrate an embodiment of a combination of a carrier block and gripper block assembly 10 configured to be coupled to an apparatus that conveys a length of tubing into a bore, such as various pipes, pipelines, conduits, wellbores, and other others. For example, the apparatus may be a coiled tubing apparatus, amongst others, used in the oil and gas industry.

The combination 10 includes a gripper block 20. The gripper block 20 includes a lower surface 22. The lower surface 22 optionally includes at least one of a female alignment feature (not illustrated) and a male alignment feature 24, as illustrated in FIG. 3. In other words, the alignment feature either extends outwardly and away from the lower surface 22 in the case of a male alignment feature or the alignment feature extends inward and into the lower surface 22 in the case of a female alignment feature. The alignment feature, whether male or female, may include at least one and, in some instances, a variety of slots and/or keys of various shapes. For example, FIG. 3 illustrates a key in the shape of a rectangle. As illustrated, the rectangular key includes filleted corners with a radius of curvature. Other shapes of the slots and keys also may be employed, including squares, trapezoids, parallelograms, circles or ellipses, cruciform shapes, T-shapes and X-shapes, and others. Further, the lower surface 22 may include a mixed combination of male and female alignment features. As will be explained below, the alignment feature 24 of the gripper block 20 engages with a complementary alignment feature 54 on the carrier block 50.

The gripper block 20 also includes a first side 30 and a second side 32 spaced apart from the first side 30. The first side 30 and the second side 32 are positioned adjacent to the lower surface 22.

The gripper block 20 also includes an upper surface 40 spaced apart from the lower surface 22. The upper surface 40 spans the distance between the first side 30 and the second side 32. The upper surface 40 includes a gripping surface 42 that extends towards the lower surface 22, wherein the gripping surface 42 includes at least one gripping element 44 positioned thereon. The gripping surface 42 may span a portion or the entire upper surface 40. The gripping surface 42 is configured to interact with and apply sufficient friction force against a portion of the tubing so as to urge the tubing either into or out of the bore as desired. The gripping surface 42, consequently, includes one or more features or gripping elements 44 such as one or more ridges and grooves, as illustrated, blocks, teeth, and other known gripping features. The gripping surface 42 optionally includes a radius of curvature to provide a rounded surface that interacts with a surface of the tubing. Alternatively, the gripping surface 42 may include a V-shape when viewed in cross-section rather than the illustrated concave shape.

The gripper block 20 also includes at least one recess 34 positioned at least partially within at least one of the first side 30 and the second side 32 of the gripper block 20. As illustrated in FIGS. 1-3, only the recess 34 positioned with the first side 30 is illustrated, but the gripper block 20 includes another recess 34 positioned within the second side 32 that is not illustrated. While only one recess 34 is positioned in each of the first side 30 and the second side 32, there optionally may be a plurality of recesses positioned in one or both of the first side 30 and the second side 32. The recess 34 includes at least one engagement surface 35 that interacts with a portion of the retention device 80. Optionally, the recess 34 extends away from and into at least one of the first side 30 and the second side 32. In some embodiments, the recess 34 extends only partially into the gripper block 20, as illustrated in FIGS. 1-3, while in other embodiments the recess 34 extends through the gripper block 20. The recess 34 as illustrated in FIGS. 1-3 is rectangular in shape at the surface of the first side 30, although the recess 34 may be of any shape at the surface of the first side 30, including square or any other polygonal shape, round, or elliptical. The recess 34 optionally includes a width 36 at the surface of one of the first side 30 and the second side 32 that is equal to or greater than a chord that transects an arc 87 traveled by an arm 90 of a retention feature 88 as it rotates about a longitudinal axis 86 of the retention device 80. The chord is defined by a plane that is coincident to the surface of one of the first side 30 and the second side 32.

Optionally, the recess 34 includes one or more side walls 37 and/or a top 38, as illustrated in FIG. 3. The engagement surface 35, side walls 37, and the top 38, may be curved and/or they may intersect the surface of one of the first side 30 and the second side 32 at an angle other than perpendicular to the surface.

Optionally, and as will be discussed below in relation to FIGS. 4-7, the recess 34 may be a through-hole through which the second end 84 of the retention device 80 extends. The recess 34 may extend through at least one of the male alignment feature 24 and/or the female alignment feature, such as at least one key and one slot, of the gripper block 20. In addition, the recess 34 may be positioned at least partly or wholly within the upper surface 40 of the gripper block 20, as will be discussed below in relation to FIGS. 4-7.

The combination 10 includes a retention device 80 configured to couple the gripper block 20 to a carrier block 50, as illustrated in FIGS. 1 and 2. The retention device 80 includes a first end 82 and a second end 84 spaced apart from the first end 82. A longitudinal axis 86 extends between the first end 82 and the second end 84 of the retention device 80. Optionally, the retention device 80 further includes a retention feature 88 proximate the first end 82 and extending laterally away from the longitudinal axis 86. The retention feature 88 is configured to engage with the engagement surface 35 of the least one recess 34 of the gripper block 20. As illustrated in FIGS. 1 and 2, the retention feature 88 is an arm 90 that extends laterally away from the longitudinal axis 86 of the retention device 88. The arm 90 may include a ridge 92 that extends away from a longitudinal axis 91 of the arm 90. Alternatively or additionally, the retention feature 88 may include collars, rings, washers, screw or bolt caps, and other similar features. The retention feature 88 may be rotatable about the longitudinal axis 86 of the retention device 80. For example, the retention feature 88, such as the arm 90, may travel in an arc 87 (FIG. 1) as it rotates about a longitudinal axis 86 of the retention device 80.

Optionally, the retention device may include collars, spacers, and washers, and other spacing features 89 that do not engage with the engagement surface 35 of the recess 34.

The retention device 80 may be removable from at least the carrier block 50 and it may also be removable from the gripper block 20. Of course, the retention device 80 may be coupled to one or both of the carrier block 50 and the gripper block 20 to prevent the removal of the retention device 80 from either block.

The retention device 80 may be rotatable about the longitudinal axis 86 of the retention device 80. The retention device 80 may include threads 94 along a portion 95 of the retention device 80 between first end 82 and the second the second end 84 of the retention device 80. As illustrated in FIG. 2, the threads 94 are proximate the second end 84 of the retention device 80. The retention device 80 thus may be of any variety of threaded screws, bolts, and other similar devices. The retention device 80, consequently, may be manipulated manually or with any manner of screwdrivers, Allen or hex keys, sockets, wrenches, and the like. The threads 94 may couple to a threaded portion of a retention recess 58 of the carrier block 50, or the threads may couple to a bolt, for example, should the retention recess 58 extend through the carrier block 50.

Optionally, the retention device 80 includes a biasing mechanism 96 configured to apply a force against at least one of the carrier block 50, the retention device 80, and the gripper block 20 when the retention device 80 couples the gripper block 20 to the carrier block 50. The biasing mechanism 96 may include any variety of springs, split or lock washers, rubber elements, and other similar structures that are capable of applying a force when compressed.

Optionally, and as will be discussed in relation to FIGS. 4-7, the retention device 80 includes a latch that rotates about an axis perpendicular to the longitudinal axis 86.

The combination 10 also includes a carrier block 50 configured to be coupled to the apparatus that conveys the length of tubing into the bore. The combination 10 is suitable to be used with any variety of carrier block known in the art when the carrier block includes the features suitable for combination with the retention devices 80 and gripper blocks 20 described herein.

The carrier block 50 includes a carrier upper surface 52 with an alignment feature 54 configured to be complementary to the at least one of the male alignment feature 24 and the female alignment feature of the gripper block 20. In other words, the alignment feature 54 either extends outwardly and away from the upper surface 52 in the case of a male alignment feature, or the alignment feature 54 extends inward and into the upper surface 52 in the case of a female alignment feature. For example, the carrier block 50 includes a slot 56 suitable for receiving the key/male alignment feature 24 of the gripper block 20. Consequently, the slot 56 is rectangular shape with filleted corners that include a radius of curvature. Of course, the alignment feature 54 may be either a male and/or a female alignment feature and it may optionally include a plurality of alignment features. The alignment feature 54, whether male or female, may include at least one and, in some instances, a variety of slots and/or keys of various shapes. Other shapes of the slots and keys also may be employed, including squares, trapezoids, parallelograms, circles or ellipses, cruciform shapes, T-shapes, X-shapes, and others.

An advantage of the alignment feature 24 of the gripper block 20 and the alignment feature 54 of the carrier block 50 is that the gripper block 20 and the carrier block 50 are more easily coupled as this arrangement of alignment features 24, 54 eliminates the relative horizontal motion of those gripper blocks that use dovetail features to couple with complementary dovetail features on a carrier block. Thus, the disclosed alignment features reduce the time to assemble and disassemble the combination.

Another advantage of the alignment feature 24 of the gripper block 20 and the alignment feature 54 of the carrier block 50 is that the alignment features allow for tighter tolerances and, consequently, less play in the coupling of the gripper block 20 and the carrier block 50 as compared to gripper blocks and carrier blocks using complementary dovetail features. This provides for a better transfer of forces between the gripper block 20 and the carrier block 50 by reducing impact loading that might occur in a looser fitting connection and by eliminating the force concentrators that exist at the edges of the dovetails that cause the edges of the dovetails to be susceptible to breaking.

The carrier block 50 includes at least one retention recess 58 disposed at least partially through the carrier block 50. The retention recess 58 is configured to receive the second end 84 of the retention device 80. As illustrated in FIGS. 1 and 2, the retention recess 58 is positioned within a lateral extension 60, although in other embodiments the retention recess 58 may be positioned alternatively or additionally in at least a portion of the top surface 52 of the carrier block 50 and/or at least within a portion of the alignment feature 54. The retention recess 58 optionally is at least partially threaded or it may simply be a blind hole without threads. In some embodiments the retention recess 58 is a through hole.

The carrier block 50, as disclosed, includes lateral extensions 60 with at least one connection recess 62 that is configured to receive a coupling device of the apparatus that conveys a length of tubing into a bore. This may be bolts, screws, rods, roll pins, and other similar structures. The carrier block 50 may include different structures configured to couple the carrier block 50 to the apparatus that conveys a length of tubing into the bore.

FIGS. 4-7 illustrate an alternative embodiment of the combination of a gripper block and a carrier block. The element numbers are incremented by 100 (e.g., a combination 110). Unless noted otherwise, similarly identified features and numbers incorporate those previously recited. Thus, any of the features of the embodiment of FIGS. 1-3 may be incorporated into the embodiment illustrated in FIGS. 4-7, including those features not expressly recited below.

Figure 4:
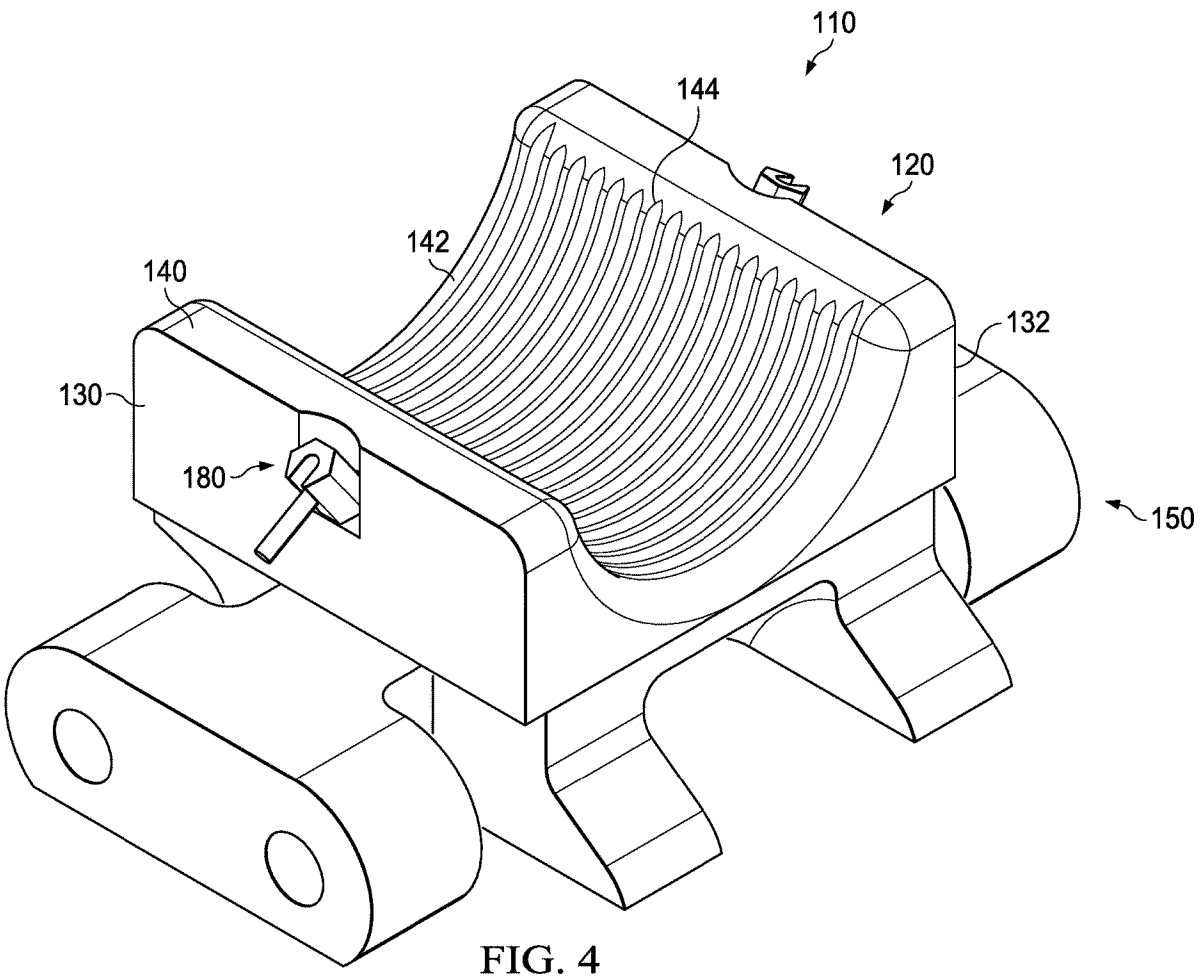
FIG. 4 is a perspective view of another embodiment of a combination of a gripper block, a carrier block, and a retention device.
Figure 5:
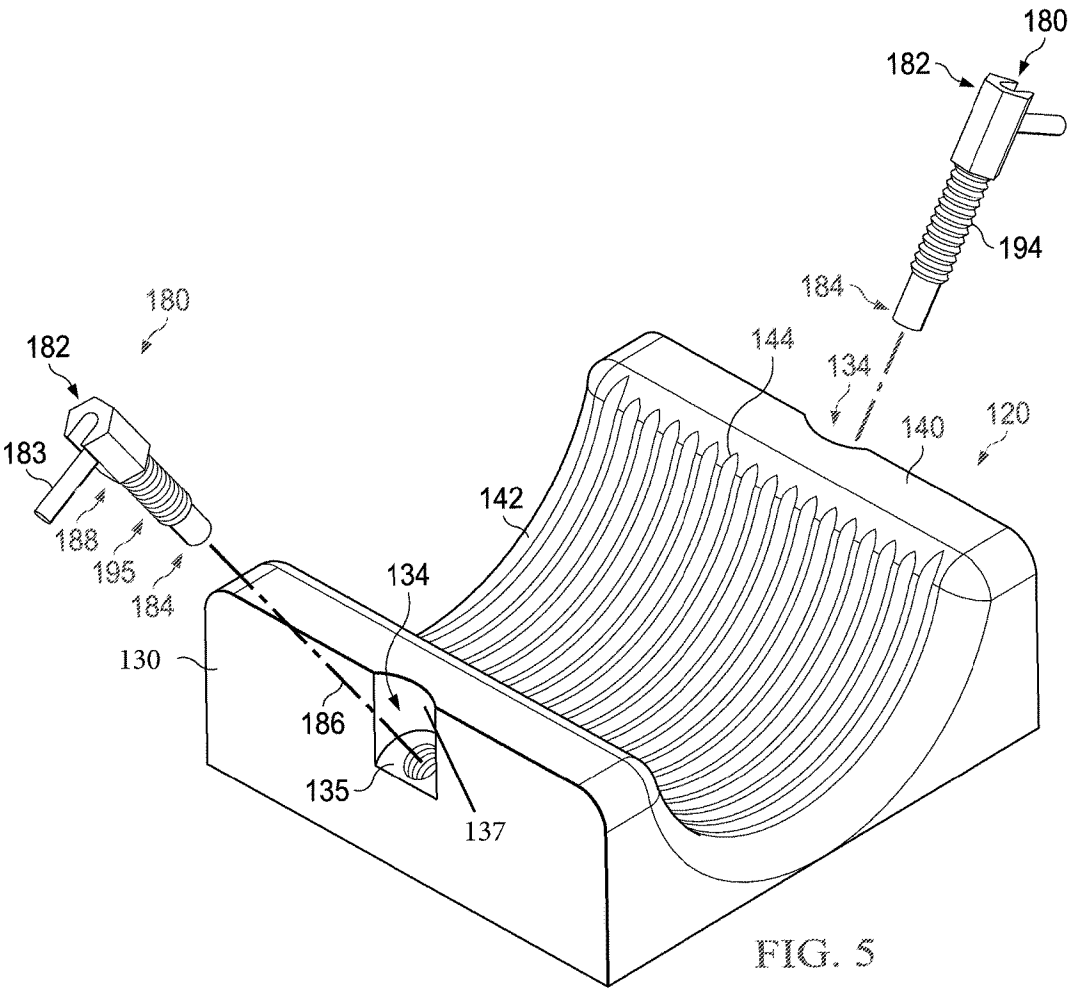
FIG. 5 is an upper perspective view of the embodiment of the gripper block in FIG. 4.
Figure 6:
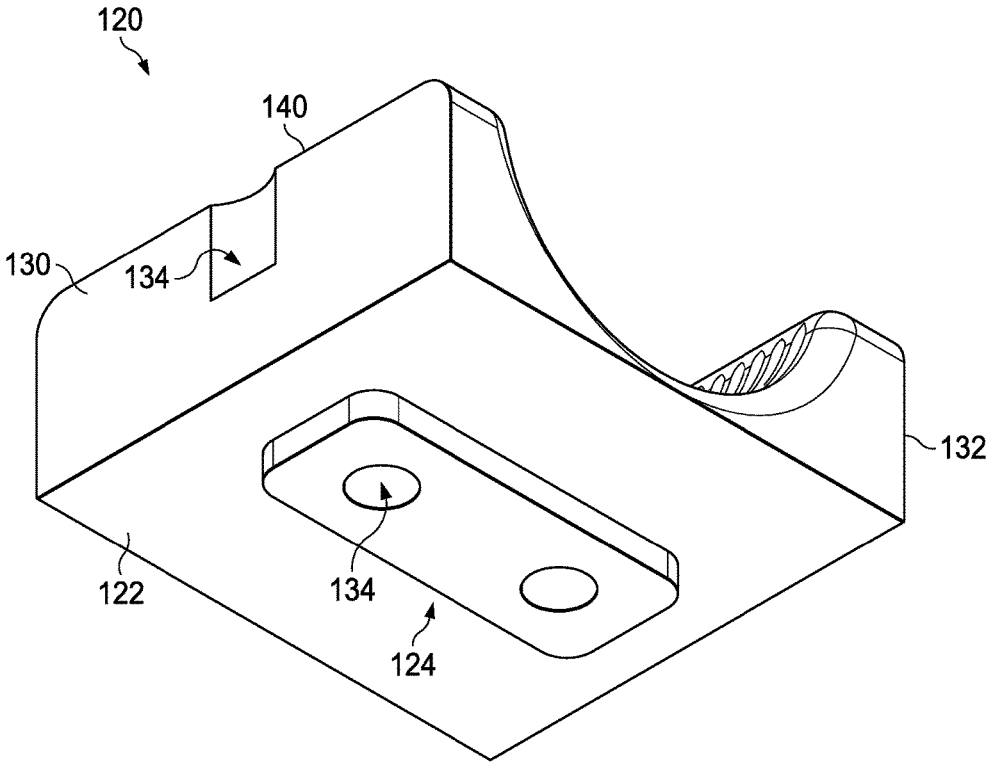
FIG. 6 is a lower perspective view of the embodiment of the gripper block in FIG. 4.

Turning to FIGS. 4-7, the combination 110 includes a gripper block 120. The gripper block 120 includes a lower surface 122. The lower surface 122 optionally includes at least one of a female alignment feature (not illustrated) and a male alignment feature 124, as illustrated in FIG. 6.

The gripper block 120 also includes a first side 130 and a second side 132 spaced apart from the first side 130. The gripper block 120 also includes an upper surface 140 spaced apart from the lower surface 122. The upper surface 140 includes a gripping surface 142 that extends towards the lower surface 122, wherein the gripping surface 142 includes at least one gripping element 144 positioned thereon.

The gripper block 120 also includes at least one recess 134 positioned at least partially within at least one of the first side 130 and the second side 132 of the gripper block 120. The recess 134 includes at least one engagement surface 135 that interacts with a portion of the retention device 180, as illustrated in FIG. 5. Optionally, and as illustrated in FIGS. 4-7, the recess 134 extends through the gripper block 120. The recess 134 as illustrated in FIGS. 4-7 is cylindrical in shape. Optionally, the recess 134 includes one or more side walls 137. The engagement surface 135 and side walls 137 may be curved and/or they may intersect the surface of one of the first side 130 and the second side 132 at an angle other than perpendicular to the surface. The recess 134 may be a through-hole through which the second end 184 of the retention device 180 extends. The recess 134 optionally may extend through at least one of the male alignment feature 124 and/or the female alignment feature, such as at least one key and one slot, of the gripper block 120. In addition, the recess 134 may be positioned at least partly or wholly within the upper surface 140 of the gripper block 120.

The combination 110 includes a retention device 180 configured to couple the gripper block 120 to a carrier block 150, as illustrated in FIG. 4. The retention device 180 includes a first end 182 and a second end 184 spaced apart from the first end 182. A longitudinal axis 186 (FIG. 5) extends between the first end 182 and the second end 184 of the retention device 180. Optionally, the retention device 180 further includes a retention feature 188 proximate the first end 182 and extending laterally away from the longitudinal axis 186. As illustrated in FIGS. 4 and 5, the retention feature 188 is in the form of a nut, cap, or collar, whether separate or integral, to the retention device 180. The retention feature 188 is configured to engage with the engagement surface 135 of the least one recess 134 of the gripper block 120. The retention feature 188 may be rotatable about the longitudinal axis 186 of the retention device 180.

The retention device 180 may include threads 194 along a portion 195 of the retention device 180 between first end 182 and the second the second end 184 of the retention device 180. The threads 194 may couple to a threaded portion of a retention recess 158 of the carrier block 150, or the threads may couple to a bolt, for example, should the retention recess 158 extend through the carrier block 150.

Optionally, the retention device 180 includes a latch 183 that rotates about an axis (not illustrated) perpendicular to the longitudinal axis 186. The latch 183, when rotated to be at an angle (such as perpendicular) to the longitudinal axis 186, may reduce the likelihood that the retention device 180 will become loose after the retention device 180 couples the gripper block 120 to the carrier block 150.

The combination 110 also includes a carrier block 150 configured to be coupled to the apparatus that conveys the length of tubing into the bore. The carrier block 150 includes a carrier upper surface 152 with an alignment feature 154 configured to be complementary to the at least one of the male alignment feature 124 and the female alignment feature of the gripper block 120.

Figure 7:
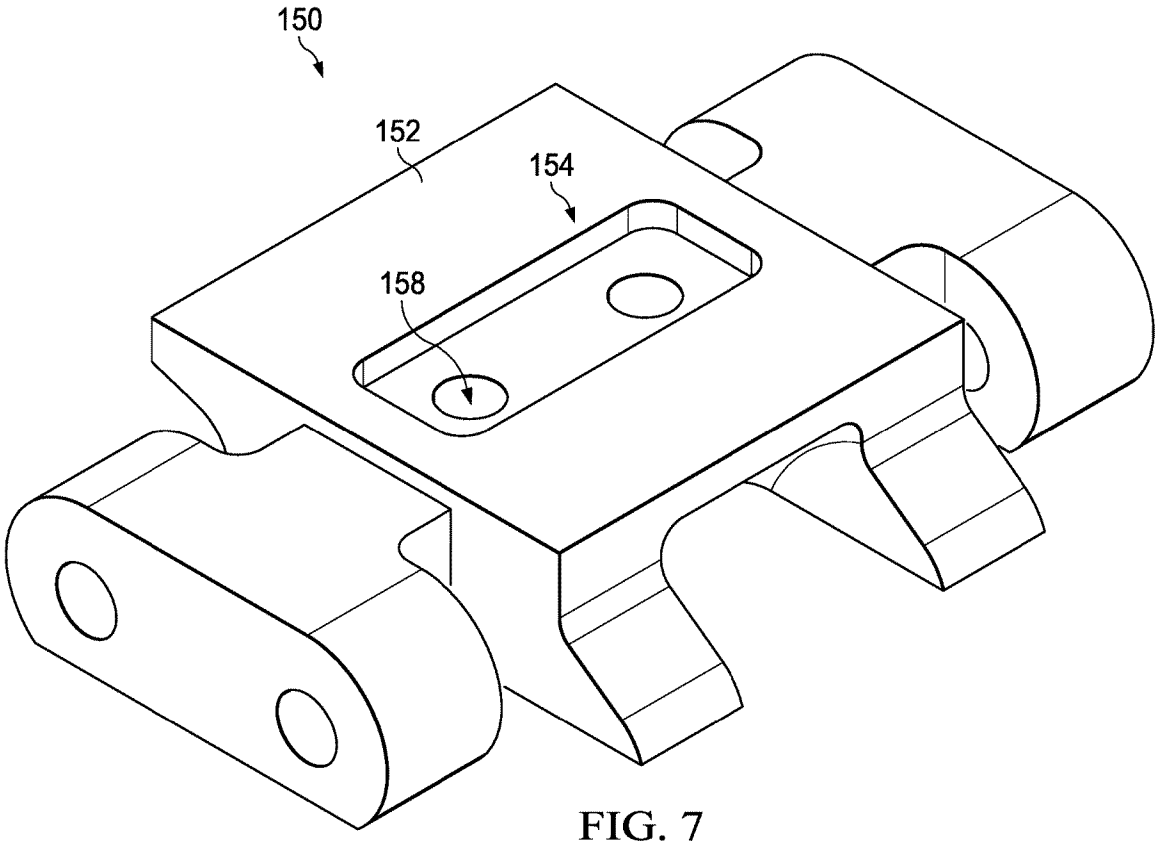
FIG. 7 is an upper perspective view of the embodiment of the carrier block in FIG. 4.

The carrier block 150 includes at least one retention recess 158 disposed at least partially through the carrier block 150. The retention recess 158 is configured to receive the second end 184 of the retention device 180. As illustrated in FIG. 7, the retention recess 158 is positioned within at least a portion of the top surface 152 of the carrier block 150 and, in this instance, within a portion of the alignment feature 154.

Figure 8:
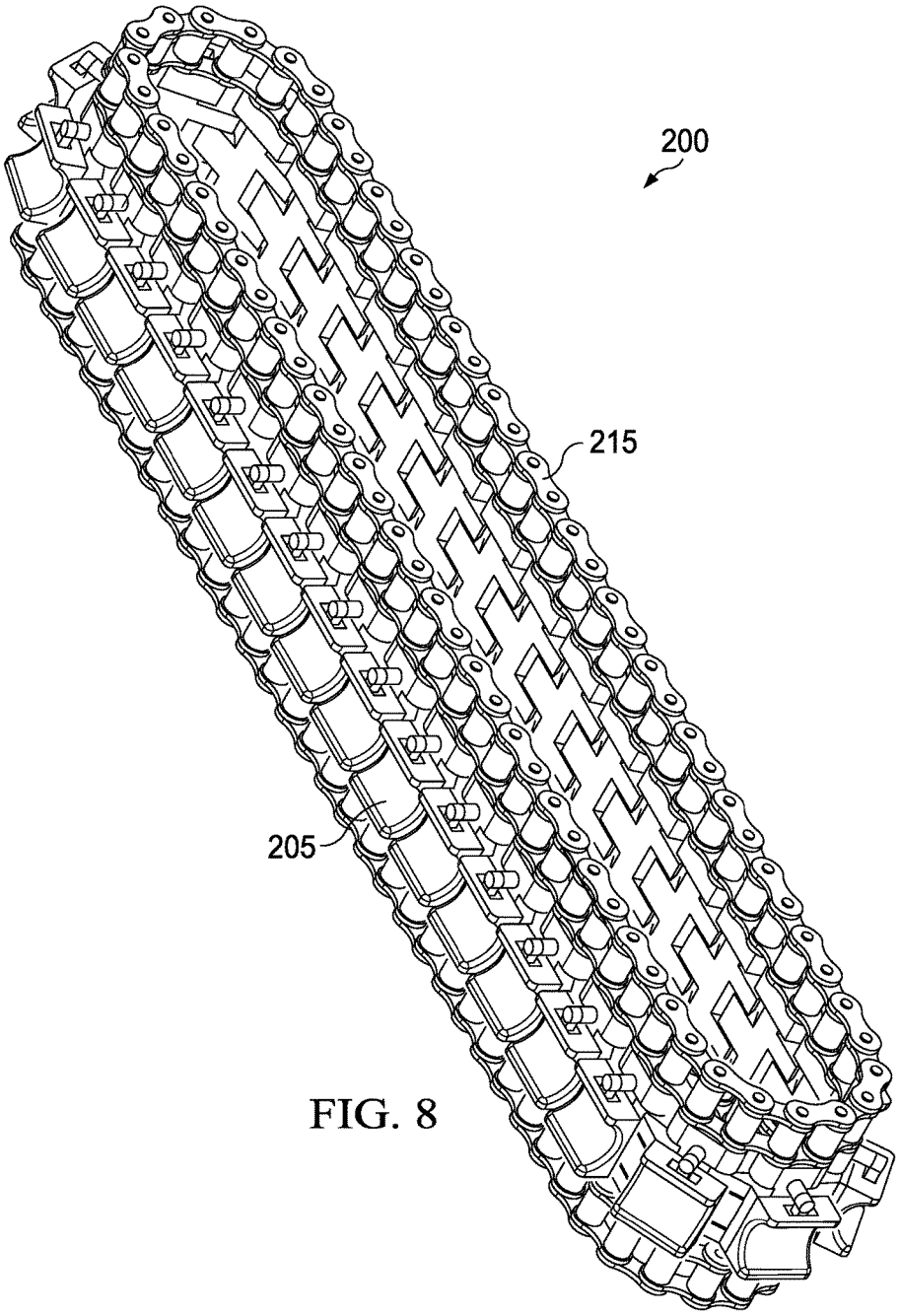
FIG. 8 is a sectional view of coiled tubing injector capable of use with various embodiments of the present invention.

In FIG. 8, a sectional view of coiled tubing injector 200 is depicted with attached carrier blocks. Carrier Block 205 interconnects with gripper band 215.

Figure 9:
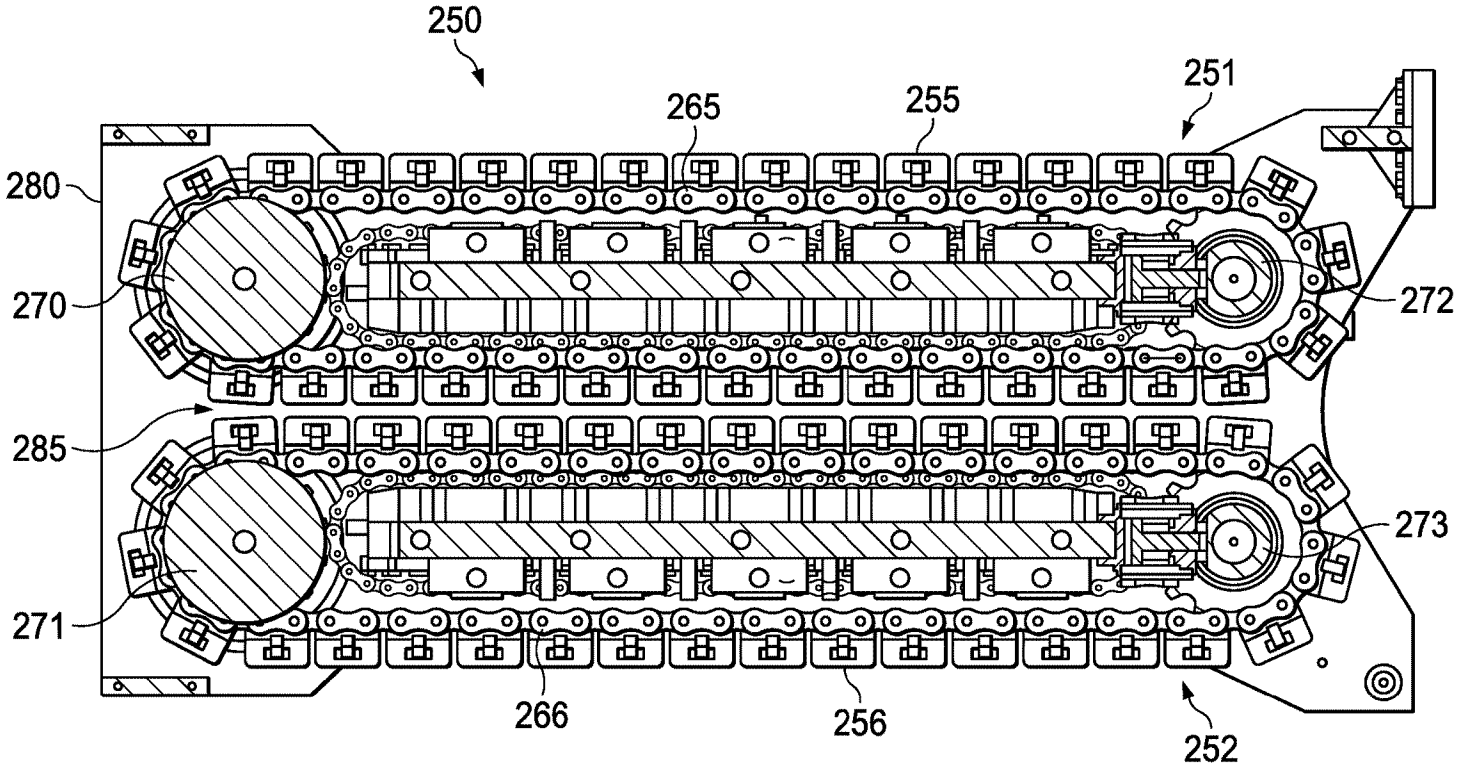
FIG. 9 is a sectional view of a coiled tubing injectors interconnected with gripper bands and revolving around gears or sprocket pairs.

In FIG. 9, a sectional view of a coiled tubing injector 250 is depicted with carrier block 255 and carrier block 256 on tubing injector 251 and tubing injector 252, respectively. Carrier block 255 interconnects with gripper band 265 and carrier block 256 interconnects with gripper band 266. Gripper band 265 revolves around gears or sprocket pair 270, 272 and gripper band 266 revolves around gear or sprocket pair 271, 273.

In alternative embodiments, gripper bands 265, 266 may be fashioned with carrier blocks 255, 256 as a single, unified component.

An exemplary embodiment illustrating use of a carrier block of the present invention is disclosed in U.S. Pat. No. 9,243,463, titled Coil Tubing Injector apparatus and method, issuing from application Ser. No. 13/743,832 filed Jan. 17, 2013. However, carrier blocks of the present invention may be used with a variety of injectors.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention claimed is:

1. A combination of a carrier block and gripper block assembly configured to be coupled to an apparatus that conveys a length of tubing into a bore, the combination comprising:

a gripper block comprising:

a lower surface with a key extending away from the lower surface;

a first side and a second side spaced apart from the first side, wherein the first side and the second side are positioned adjacent to the lower surface, and wherein each of the first side and the second side are planar, and wherein the key is spaced laterally interior from the first side and the second side;

an upper surface spaced apart from the lower surface, the upper surface spanning the distance between the first side and the second side, wherein the upper surface includes a gripping surface that extends towards the lower surface, wherein the gripping surface includes at least one gripping element positioned thereon;

at least one recess positioned at least partially within at least one of the first side and the second side of the gripper block, the at least one recess including an engagement surface, wherein the at least one recess extends through the key;

a retention device configured to couple the gripper block to a carrier block, the retention device including:

a first end;

a second end spaced apart from the first end; and, a longitudinal axis extending between the first end and the second end of the retention device; and, the carrier block configured to be coupled to the apparatus that conveys the length of tubing into the bore, the carrier block comprising;

a carrier upper surface with a slot configured to receive the key of the gripper block; and, at least one retention recess disposed within the slot and extending at least partially through the carrier block, the at least one retention recess being configured to receive the second end of the retention device.

2. The combination of claim 1, wherein the retention device further includes a retention feature proximate the first end and extending laterally away from the longitudinal axis, the retention feature being configured to engage with the engagement surface of the least one recess of the gripper block.

3. The combination of claim 2, wherein the retention feature includes at least one of (a) an arm extending laterally away from the longitudinal axis of the retention device and (b) a collar that extends laterally away from the longitudinal axis of the retention device.

4. The combination of claim 3, wherein the arm of the retention feature is rotatable about the longitudinal axis of the retention device.

5. The combination of claim 4, wherein the at least one recess includes a width at one of the first side and the second side that is greater than a chord that transects an arc traveled by the arm of the retention feature as the arm rotates about the longitudinal axis of the retention device.

6. The combination of claim 1, wherein the retention device is removable from at least the carrier block.

7. The combination of claim 1, wherein the retention device is rotatable about the longitudinal axis of the retention device.

8. The combination of claim 1, wherein the retention device includes threads along a portion of the retention device between the first end and the second end of the retention device.

9. The combination of claim 1, wherein the retention device includes a biasing mechanism configured to apply a force against at least one of the carrier block, the retention device, and the gripper block when the retention device couples the gripper block to the carrier block.

10. The combination of claim 1, wherein the at least one recess of the gripper block extends away from at least one of the first side and the second side and extends only partially into the gripper block.

11. The combination of claim 1, wherein the retention device includes a latch that rotates about an axis perpendicular to the longitudinal axis.

12. The combination of claim 1, wherein the at least one recess of the gripper block is positioned at least partly within the upper surface of the gripper block.

* * * * *